US012270275B2

(12) United States Patent
Walker et al.

(10) Patent No.: US 12,270,275 B2
(45) Date of Patent: Apr. 8, 2025

(54) ADJUSTABLE WELL WATER FLOW VALVE DEVICE

(71) Applicants: Jason Walker, Springtown, TX (US); Jackie Walker, Springtown, TX (US)

(72) Inventors: Jason Walker, Springtown, TX (US); Jackie Walker, Springtown, TX (US)

( * ) Notice: Subject to any disclaimer, the term of this patent is extended or adjusted under 35 U.S.C. 154(b) by 0 days.

(21) Appl. No.: 18/191,279

(22) Filed: Mar. 28, 2023

(65) Prior Publication Data

US 2023/0313638 A1 Oct. 5, 2023

Related U.S. Application Data

(60) Provisional application No. 63/325,822, filed on Mar. 31, 2022.

(51) Int. Cl.

| | |
|---|---|
| ***E21B 34/02*** | (2006.01) |
| ***F16K 1/02*** | (2006.01) |
| ***F16K 3/12*** | (2006.01) |
| ***F16K 25/00*** | (2006.01) |
| ***F16K 43/00*** | (2006.01) |

(52) U.S. Cl.
CPC ..... *E21B 34/02* (2013.01)

(58) Field of Classification Search
CPC ..... F16K 1/02
See application file for complete search history.

(56) References Cited

U.S. PATENT DOCUMENTS

| | | | | |
|---|---|---|---|---|
| 1,505,850 | A | 8/1924 | Benckenstein | |
| 2,114,789 | A * | 4/1938 | Urquhart | F16K 5/0278 251/333 |
| 2,805,040 | A * | 9/1957 | Voss | F17C 13/04 251/368 |
| 3,443,789 | A * | 5/1969 | Bucklin | F16K 3/12 251/360 |
| 4,244,556 | A * | 1/1981 | Miller | F16K 31/50 251/366 |
| 4,623,119 | A * | 11/1986 | van der Wiel | F16K 5/162 251/188 |
| 4,636,934 | A | 1/1987 | Schwendemann | |
| 4,776,365 | A * | 10/1988 | Bathrick | F16K 1/02 137/329.02 |
| 4,860,784 | A * | 8/1989 | Petersen | F16K 43/00 251/270 |
| 5,316,081 | A | 5/1994 | Baski | |
| 5,769,392 | A * | 6/1998 | Jeon | F16K 31/502 251/188 |
| 6,073,906 | A | 6/2000 | Wallace | |
| 6,273,195 | B1 | 8/2001 | Hauck | |

(Continued)

*Primary Examiner* — Matthew R Buck
*Assistant Examiner* — Douglas S Wood
(74) *Attorney, Agent, or Firm* — Brennan, Manna & Diamond, LLC

(57) ABSTRACT

The present invention relates to an adjustable well water flow valve device for underground well water systems. The device can be attached to a well water system to allow the user to adjust the flow within the system through a vertical opening of the restrictor within a body of the device. The fastener can be placed through the body and a horizontal opening of the restrictor, such that the fastener obstructs a portion of the vertical opening to further allow a user to increase/decrease flow through the restrictor by increasing/decreasing the size of the vertical opening.

14 Claims, 3 Drawing Sheets

(56) References Cited

U.S. PATENT DOCUMENTS

| | | | | |
|---|---|---|---|---|
| 8,651,454 | B1 * | 2/2014 | Thompson | F16K 1/04<br>251/145 |
| 2005/0022867 | A1 * | 2/2005 | Maichel | F16K 43/00<br>137/15.17 |

* cited by examiner

ADJUSTABLE WELL WATER FLOW VALVE DEVICE

CROSS-REFERENCE TO RELATED APPLICATION

The present application claims priority to, and the benefit of, U.S. Provisional Application No. 63/325,822, which was filed on Mar. 31, 2022, and is incorporated herein by reference in its entirety.

FIELD OF THE INVENTION

The present invention relates generally to the field of valves. More specifically, the present invention relates to an adjustable well water flow valve device primarily comprised of a body having at least one opening, at least one fastener, and at least one internal flow restrictor. The device can be attached to a well water system to allow the user to adjust the flow within the system through a vertical opening of the restrictor within the body. The fastener can be placed through the body and a horizontal opening of the restrictor such that the fastener obstructs a portion of the vertical opening to further allow a user to increase/decrease flow through the restrictor by increasing/decreasing the size of the vertical opening. Accordingly, the present disclosure makes specific reference thereto. Nonetheless, it is to be appreciated that aspects of the present invention are also equally applicable to other like applications, devices, and methods of manufacture.

BACKGROUND

Underground water wells are a common water source for many homes. Flow restrictors are often used in a well water system to prevent too much water from flowing through a water well. However, flow restrictors are typically fixed in the amount of flow they restrict.

Increasing and decreasing flow control can be helpful for water flow and efficiency to adhere to groundwater district rules. Further, if a water pump in a well water system cavitates due to inadequate flow pressure, the lifespan of the pump and pump motor can be greatly reduced. This can occur due to improper capability between a fixed flow restrictor and a well water system.

Therefore, there exists a long-felt need in the art for an improved flow restrictor for a well water system. More specifically, there exists a long-felt need in the art for an adjustable well water flow valve device. There also exists a long-felt need in the art for an adjustable well water flow valve device that can be adjusted to increase and decrease flow within a well water system. In addition, there exists a long-felt need in the art for an adjustable well water flow valve device that can be used to ensure efficiency within a well water system. Further, there exists a long-felt need in the art for an adjustable well water flow valve device that can be universally attached to any well water system.

The subject matter disclosed and claimed herein, in one embodiment thereof, comprises an adjustable well water flow valve device. The device is primarily comprised of a body having at least one opening, at least one fastener, and at least one internal flow restrictor. The device can be attached to a well water system to allow the user to adjust the flow within the system. The restrictor is positioned within the body and has a vertical opening that allows water to flow through the restrictor and the body. The fastener can be placed through the body and a horizontal opening of the restrictor, such that the fastener obstructs a portion of the vertical opening. This further allows a user to increase/decrease flow through the restrictor by increasing/decreasing the size of the vertical opening via the depth of the fastener within the opening.

In this manner, the adjustable well water flow valve device of the present invention accomplishes all of the foregoing objectives and provides an improved flow restrictor for a well water system that can be adjusted to increase and decrease flow within a well water system. The adjustability of the device ensures efficiency within a well water system. In addition, fasteners on both ends of the device ensure the device can be attached universally to any well water system.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an adjustable well water flow valve device. The device is primarily comprised of a body having at least one opening, at least one fastener, and at least one internal flow restrictor. The body is preferably cylindrical in shape and is comprised of a first end and a second end.

The first end and second end are both comprised of at least one fastener that is preferably comprised of a plurality of male threads. Alternatively, the fastener may be comprised of any quick-connect style connector known in the art. The fastener allows the device to install to a drop pipe of any size (or other similar structure of the like) that may be found in an underground well water system.

The body is comprised of at least one opening that extends from the first end to the second end. At least one internal flow restrictor is positioned within the body. The restrictor inhibits flow through the body, except through at least one vertical opening of the restrictor.

The body is also comprised of at least one fastener and at least one fastener opening. The fastener is preferably a threaded fastener that is received by a threaded fastener opening with reciprocating threads. The fastener opening aligns with at least one horizontal opening of the internal restrictor. The horizontal opening perpendicularly intersects the vertical opening such that the fastener can be turned through the fastener opening such that it travels through the body, through the horizontal opening of the internal restrictor, and into the vertical opening. The turning of the fastener can obstruct more or less of the vertical opening to allow the user to further adjust the flow of water through the opening by making the vertical opening larger or smaller in size.

Accordingly, the adjustable well water flow valve device of the present invention is particularly advantageous as it provides a flow restrictor for a well water system that can be adjusted to increase and decrease flow within the system. In addition, fasteners on both ends of the device ensure the device can be attached universally to any well water system. In this manner, the adjustable well water flow valve device overcomes the limitations of existing valve devices known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
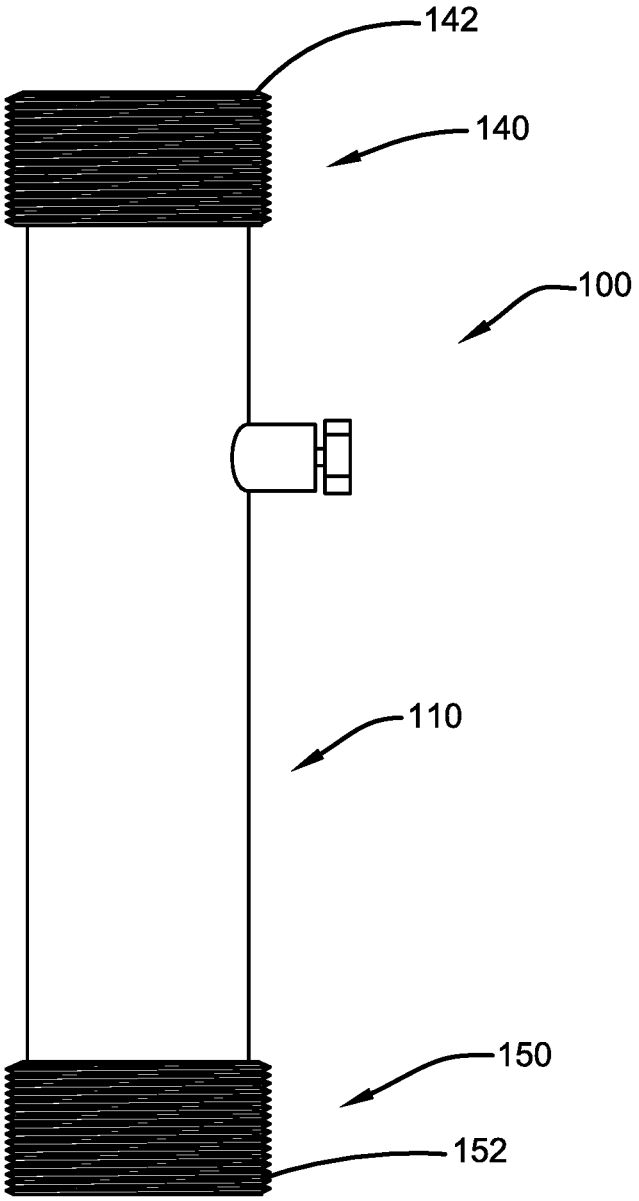
FIG. 1 illustrates a perspective view of one potential embodiment of an adjustable well water flow valve device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an improved flow restrictor for a well water system. More specifically, there exists a long-felt need in the art for an adjustable well water flow valve device. There also exists a long-felt need in the art for an adjustable well water flow valve device that can be adjusted to increase and decrease flow within a well water system. In addition, there exists a long-felt need in the art for an adjustable well water flow valve device that can be used to ensure efficiency within a well water system. Further, there exists a long-felt need in the art for an adjustable well water flow valve device that can be universally attached to any well water system.

The present invention, in one exemplary embodiment, is comprised of an adjustable well water flow valve device. The device is primarily comprised of a body having at least one opening, at least one fastener, and at least one internal flow restrictor. The body is preferably cylindrical in shape and is comprised of a first end and a second end.

Both the first end and the second end are comprised of at least one fastener. The fastener is preferably comprised of a plurality of male threads. Alternatively, the fastener may be comprised of any quick-connect style connector known in the art. The fastener allows the device to install to a drop pipe of any size (or other similar structure of the like) that may be found in an underground well water system.

The body is comprised of at least one opening. The opening extends from the first end to the second end. At least one internal flow restrictor is positioned within the body. The restrictor inhibits flow through the body, except through at least one vertical opening of the restrictor.

The body is also comprised of at least one fastener and at least one fastener opening. The fastener is preferably threaded. The fastener is received by a threaded fastener opening with reciprocating threads. The fastener opening aligns with at least one horizontal opening of the internal restrictor. The horizontal opening perpendicularly intersects the vertical opening, such that the fastener can be turned through the fastener opening such that it travels through the body, through the horizontal opening of the internal restrictor, and into the vertical opening. The turning of the fastener can obstruct more or less of the vertical opening to allow the user to further adjust the flow of water through the opening by making the vertical opening larger or smaller in size.

Accordingly, the adjustable well water flow valve device of the present invention is particularly advantageous as it provides a flow restrictor for a well water system that can be adjusted to increase and decrease flow within the system. In addition, fasteners on both ends of the device ensure the device can be attached universally to any well water system. In this manner, the adjustable well water flow valve device overcomes the limitations of existing valve devices known in the art.

Referring initially to the drawings, FIG. 1 illustrates a perspective view of one potential embodiment of an adjustable well water flow valve device 100 of the present invention in accordance with the disclosed architecture. The device 100 is primarily comprised of a body 110 having at least one opening 112, at least one fastener 120, and at least one internal flow restrictor 160. The device 100 and all components are preferably made from a durable metal material such as, but not limited to, stainless steel, cast iron, aluminum, copper, brass, etc. The metal material is preferably corrosion-resistant to prevent rust.

In another embodiment, all or some components of the device 100 may be made from a rigid plastic. The plastic may be a plurality of plastic types such as, but not limited to, acrylic, polycarbonate, polyethylene, thermoplastic, acrylonitrile butadiene styrene, low-density polyethylene, medium-density polyethylene, high-density polyethylene, polyethylene terephthalate, polyvinyl chloride, polystyrene, polylactic acid, acetal, nylon, fiberglass, recycled plastic, biodegradable plastic, etc.

The body 110 is preferably cylindrical in shape. However, the body 110 may be any shape known in the art. This shape includes, but is not limited to, square, rectangular, triangular, circular, polygonal, etc., or any other shape known in the art.

The body 110 is comprised of a first end 140 and a second end 150. The first end 140 is comprised of at least one fastener 142. In one embodiment, the fastener 142 is comprised of a plurality of male threads. In another embodiment, the fastener 142 is comprised of any quick-connect style connector known in the art. The fastener 142 may be any fastener type known in the art that allows the device 100 to install to a drop pipe of any size (or other similar structure of the like) that may be found in an underground well water system.

The second end 150 is comprised of at least one fastener 152. In one embodiment, the fastener 152 is comprised of a plurality of male threads. In another embodiment, the fastener 152 is comprised of any quick-connect style connector known in the art. The fastener 152 may be any fastener type known in the art that allows the device 100 to install to a drop pipe of any size (or other similar structure of the like) that may be found in an underground well water system.

The body 110 is comprised of at least one opening 112 that extends from the first end 140 to the second end 150. In this manner, the body 110 is hollow. The opening 112 allows water to flow through the body 110 during use.

Figure 2:
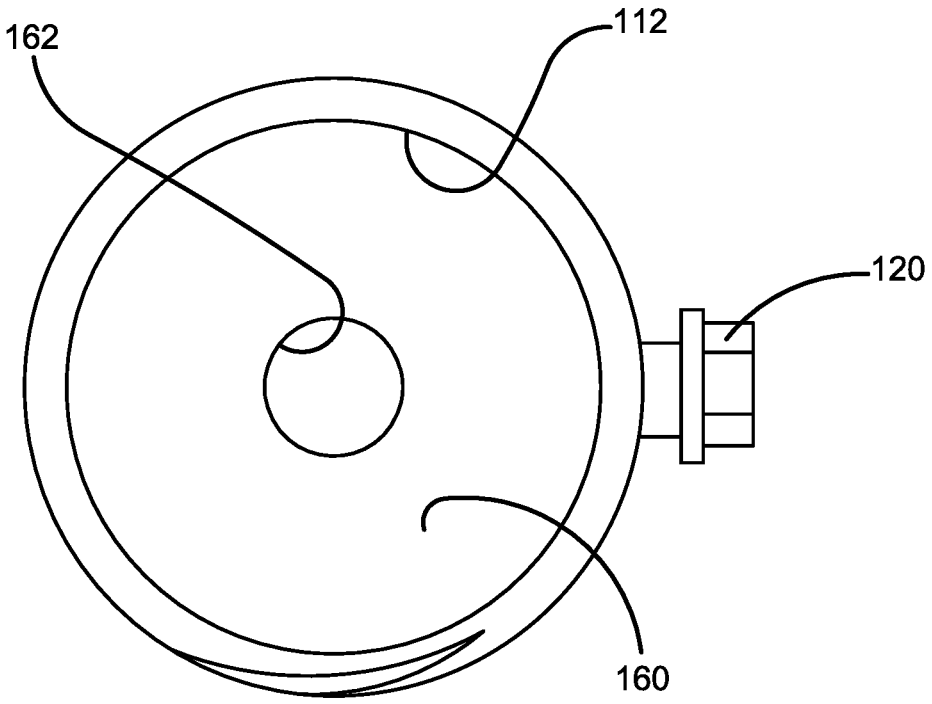
FIG. 2 illustrates a top view of one potential embodiment of an adjustable well water flow valve device of the present invention in accordance with the disclosed architecture.

FIG. 2 illustrates a top view of one potential embodiment of an adjustable well water flow valve device 100 of the present invention in accordance with the disclosed architecture. At least one internal flow restrictor 160 is positioned within the body 110. The flow restrictor 160 is preferably the same shape as the body 110 (but smaller in size, such that it fits inside the body 110), such that it inhibits flow through the body 110, except through at least one vertical opening 162. Therefore, the flow of water through the body 110 is limited by the restrictor 160 and can only flow through the opening 162.

The body 110 is also comprised of at least one fastener 120 and at least one fastener opening 130. The fastener 120 is preferably a threaded fastener such as, but not limited to, a bolt. The opening 130 is preferably a threaded opening with reciprocating threads that correspond with the fastener 120.

Figure 3:
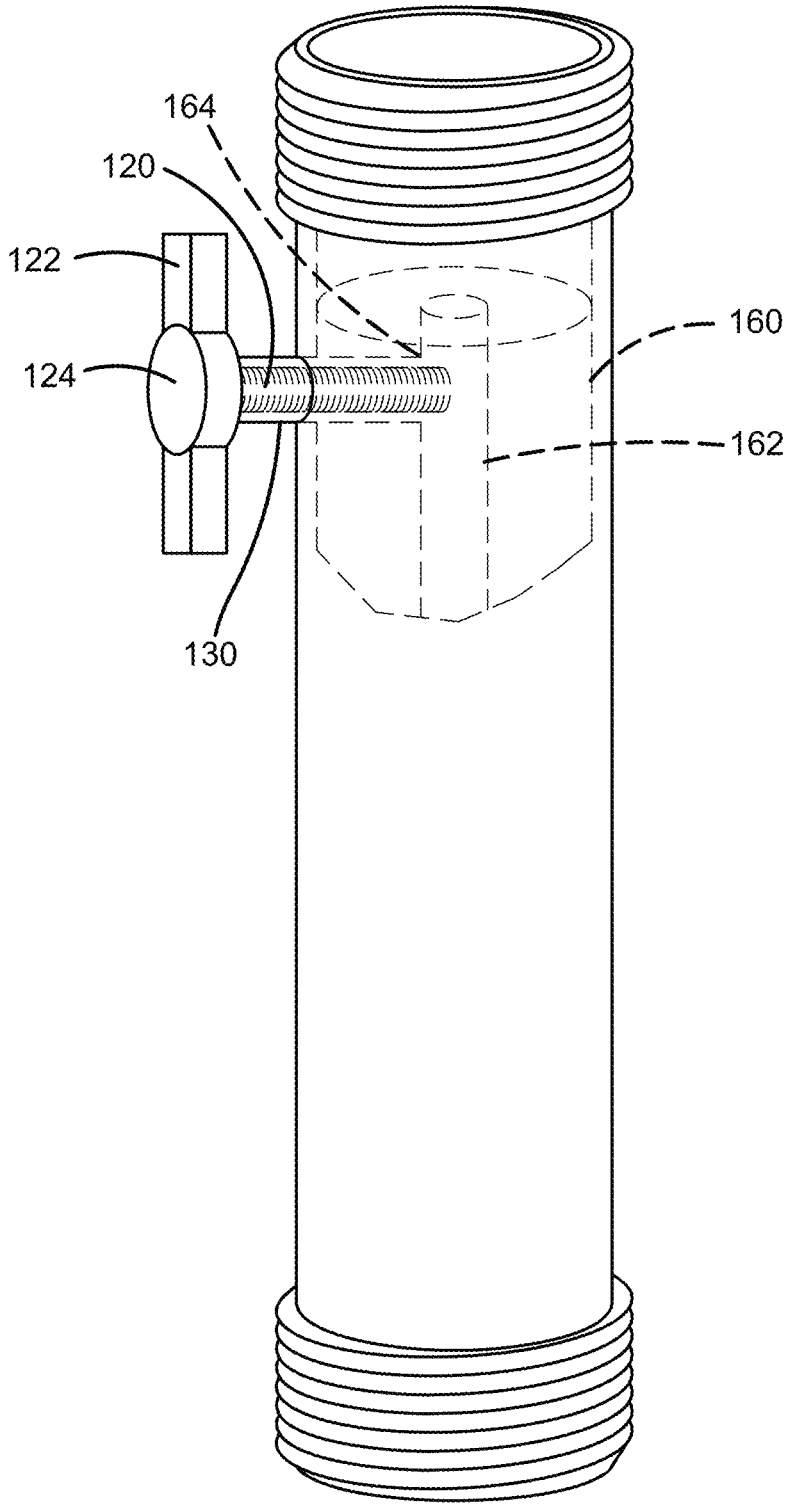
FIG. 3 illustrates a perspective view of one potential embodiment of an adjustable well water flow valve device of the present invention in accordance with the disclosed architecture.

FIG. 3 illustrates a perspective view of one potential embodiment of an adjustable well water flow valve device 100 of the present invention in accordance with the disclosed architecture. The fastener opening 130 aligns with at least one horizontal opening 164 of the internal restrictor 160. The horizontal opening 164 perpendicularly intersects the vertical opening 162. In this manner, the fastener 120 can be turned through the fastener opening 130 such that it travels through the body 110, through the horizontal opening 164 of the internal restrictor 160, and into the vertical opening 162.

As a result, the fastener 120 can be turned as needed to obstruct more or less of the vertical opening 162. This allows a user to further adjust the flow of water through the opening 162 by making the vertical opening 162 larger or smaller in size. It should be appreciated that the vertical opening 162 may be any diameter in any embodiment of the device 100 to allow for numerous flow rates of water (as a result of various opening 162 diameters) through the device 100. In addition, the fastener 120 also secures the restrictor 160 in position.

In one embodiment, the device 100 is comprised of a plurality of internal restrictors 160. Each restrictor 160 is comprised of at least one vertical opening 162, which may vary in diameter. As a result, a user can insert the desired restrictor 160 with the desired flow rate (i.e., the desired opening 162 diameter) into the body 110 and secure the restrictor 160 within the body 110 by turning the fastener 120 through the fastener opening 130 and into at least the horizontal opening 164. The fastener 120 can then be further turned into the vertical opening 162 as desired.

In one embodiment, the fastener 120 is comprised of at least one handle 122. The handle 122 may be any shape known in the art that increases the surface area of the fastener 120, such that it can be easily turned. In one embodiment, the handle 122 may be generally rectangular in shape.

The handle 122 may also have at least one grip area 124. The grip area 124 may be textured with a recessed or raised texture or may be non-textured. The grip area 124 is preferably made from a non-slip material that improves grip such as, but not limited to, silicone, latex, neoprene, EPDM, PVC foam, polyethylene, sponge rubber, silicone foam, urethane, cork, ridged and/or recessed rubber, felt, acrylic, polyester & SBR, etc.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "adjustable well water flow valve device" and "device" are interchangeable and refer to the adjustable well water flow valve device 100 of the present invention.

Notwithstanding the foregoing, the adjustable well water flow valve device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the adjustable well water flow valve device 100 as shown in the FIGS. are for illustrative purposes only, and that many other sizes and shapes of the adjustable well water flow valve device 100 are well within the scope of the present disclosure. Although the dimensions of the adjustable well water flow valve device 100 are important design parameters for user convenience, the adjustable well water flow valve device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An adjustable well water flow valve device comprising:

a body having an opening;

a first end;

a first fastener positioned on the first end;

a second end;

a second fastener positioned on the second end;

a body fastener comprising a handle;

a body fastener opening configured to retain the body fastener; and an internal restrictor having a vertical opening in line with the first and second ends of the adjustable well water flow valve device and a horizontal opening; and wherein the internal restrictor is insertable within the body; and wherein the handle comprises a non-slip silicone foam grip with a raised texture; and wherein the body fastener opening is between the first and second ends of the adjustable well water flow valve device and aligns with and perpendicularly intersects the horizontal opening of the internal restrictor.

2. The adjustable well water flow valve device of claim 1, wherein the first fastener is comprised of a thread.

3. The adjustable well water flow valve device of claim 1, wherein the second fastener is comprised of a thread.

4. An adjustable well water flow valve device comprising:

a body having an opening;

a first end;

a first fastener;

a second end;

a second fastener;

a body fastener comprising a handle;

a body fastener opening configured to retain the body fastener; and an internal restrictor comprised of a vertical opening in line with the first and second ends of the adjustable well water flow valve device and a horizontal opening; and wherein the internal restrictor is insertable within the body; and wherein the handle comprises a non-slip rubber grip with a recessed texture; and wherein the body is a biodegradable plastic body; and wherein the body fastener opening is between the first and second ends of the adjustable well water flow valve device and aligns with and perpendicularly intersects the horizontal opening of the internal restrictor.

5. The adjustable well water flow valve device of claim 4, wherein the first fastener is comprised of a quick connector.

6. The adjustable well water flow valve device of claim 4, wherein the second fastener is comprised of a quick connector.

7. The adjustable well water flow valve device of claim 4, wherein the internal restrictor is cylindrically shaped.

8. The adjustable well water flow valve device of claim 4, wherein the body is cylindrically shaped.

9. An adjustable well water flow valve device comprising:

a body having an opening;

a first end comprised of a first fastener;

a second end comprised of a second fastener;

a body fastener comprised of a handle;

a body fastener opening configured to retain the body fastener; and a plurality of internal restrictors each having a vertical opening in line with the first and second ends of the adjustable well water flow valve device, a horizontal opening, and a different diameter; and wherein each internal restrictor is removably insertable within the body; and wherein the handle comprises a non-slip polyethylene grip with a raised texture; and wherein the body is a recycled plastic body; and wherein the body fastener opening is between the first and second ends of the adjustable well water flow valve device and aligns with and perpendicularly intersects the horizontal opening of the internal restrictor.

10. The adjustable well water flow valve device of claim 9, wherein the body fastener is comprised of a threaded bolt.

11. The adjustable well water flow valve device of claim 9 further comprised of a threaded fastener opening.

12. The adjustable well water flow valve device of claim 9, wherein the body is comprised of a corrosion-resistant material.

13. The adjustable well water flow valve device of claim 12, wherein the corrosion-resistant material is comprised of a metal.

14. The adjustable well water flow valve device of claim 12, wherein the corrosion-resistant material is comprised of a plastic.

* * * * *